United States Patent [19]

Bettigole

[11] Patent Number: 4,531,859

[45] Date of Patent: Jul. 30, 1985

[54] PREFABRICATED PAVEMENT MODULE

[76] Inventor: Neal H. Bettigole, 89 Howard Dr., Old Tappan, N.J. 07675

[21] Appl. No.: 501,145

[22] Filed: Jun. 6, 1983

Related U.S. Application Data

[63] Continuation-in-part of Ser. No. 428,861, Sep. 30, 1982.

[51] Int. Cl.[3] ..... E01C 5/22

[52] U.S. Cl. ..... 404/73; 404/44; 404/45; 14/73; 52/666; 52/309.17

[58] Field of Search ..... 404/18, 34, 35, 44, 404/45, 73; 14/73, 6; 52/333, 334, 408, 411, 666, 667, 668, 309.17

[56] References Cited

U.S. PATENT DOCUMENTS

| | | | |
|---|---|---|---|
| 185,302 | 12/1876 | Davison | 404/18 |
| 1,033,106 | 7/1912 | Kahn | 52/88 |
| 1,300,439 | 4/1919 | Madison | 404/18 X |
| 1,984,944 | 12/1934 | Piccirilli | 404/34 |
| 2,096,629 | 10/1937 | Farrar et al. | 52/334 X |
| 2,162,742 | 6/1939 | Nagin | 14/73 |
| 2,184,146 | 12/1939 | Leguillon | 404/32 |
| 2,437,095 | 3/1948 | Kähr | 404/18 X |
| 2,880,116 | 3/1959 | Alps et al. | 404/18 X |
| 3,110,049 | 11/1963 | Nagin | 14/73 |
| 3,110,981 | 11/1963 | Larner | 52/408 X |
| 3,260,023 | 7/1966 | Nagin | 14/73 X |
| 3,363,379 | 1/1968 | Curran | 52/334 |
| 3,545,348 | 12/1970 | Anderson | 404/30 |
| 3,645,510 | 2/1972 | Klugman | 52/667 X |
| 3,855,747 | 12/1974 | Langan | 52/404 |
| 3,906,571 | 9/1975 | Zetlin | 14/17 |
| 4,102,102 | 7/1978 | Greulich | 14/73 X |
| 4,145,153 | 3/1979 | Fasullo et al. | 404/73 |
| 4,151,025 | 4/1979 | Jacobs | 14/73 X |
| 4,168,924 | 9/1979 | Draper et al. | 404/70 |
| 4,201,023 | 5/1980 | Jungbluth | 52/334 |
| 4,244,768 | 1/1981 | Wiechowski et al. | 52/667 X |
| 4,282,619 | 8/1981 | Rooney | 14/6 |
| 4,300,320 | 11/1981 | Rooney | 52/173 |

*Primary Examiner*—James A. Leppink
*Assistant Examiner*—Beverly E. Hjorth
*Attorney, Agent, or Firm*—Banner, Birch, McKie & Beckett

[57] ABSTRACT

A light weight pavement module is described which comprises a base grating, an impervious intermediate layer, such as a reinforced plastic or fiberglass sheet applied over the base grating, and a concrete top layer wear surface applied over the intermediate layer. The intermediate layer prevents the concrete top layer from penetrating through the base grating. The grating has shear connectors which pierce the intermediate layer and project into the top layer wear surface in order to form an integral pavement module. The pavement module may be formed without an intermediate layer if the module is otherwise constructed so that the top layer wear surface does not penetrate and fill the interstices of the base grating.

5 Claims, 2 Drawing Figures

PREFABRICATED PAVEMENT MODULE

This application is a continuation-in-part of application Ser. No. 428,861, filed Sept. 30, 1982.

BACKGROUND OF THE INVENTION

1. Field of the Invention

This invention relates to the construction and repair of bridge decks, roads and sidewalks. In particular, this invention provides an integral, preformed module which can be constructed in a factory under ideal conditions and transported to a construction site to construct or repair a bridge deck, roadway, sidewalk or similar area on which is desired a hard wear surface.

2. Background Art

It is well-known to use modular, precast concrete slabs to construct roadways, sidewalks, bridge decks and similar surfaces. An example of such precast concrete paving slabs which may be set upon a roadway subsurface is disclosed in U.S. Pat. No. 1,984,944. It is also known to reinforce concrete roadways, whether constructed in modular form or as a continuous casting at the job site, with metal or plastic grids, as is disclosed in U.S. Pat. Nos. 2,184,146 and 4,168,924. These grids, however, are used solely for reinforcement and not as a base for a pavement module. It is also known to use a polyethylene or paper sheet over a base layer of resilient hydrophobic particles to prevent displacement of the particles and to prevent curing of the concrete to the particles, as is disclosed in U.S. Pat. No. 3,545,348.

The prior art precast, modular concrete panels in which a grating or grid is used allow the concrete to fill the interstices of the grating or grid. This results in an extremely heavy modular panel which is unwieldy and costly to transport to construction sites and imposes undesirable dead load which serves no useful purpose in bridge deck construction. Open grating bridge decks without a concrete or similar wear surface are unacceptable because they are too dangerous to traffic.

SUMMARY OF THE INVENTION

The invention disclosed and claimed herein is an integal, preformed pavement module. The module is comprised of a base member having shear connectors thereon as a support for the module, and a top layer wear surface on top of the base member. The base layer in the preferred embodiment is a grating which is intended to be placed on the prepared surface of a road bed or on the structural framing for a bridge deck. On top of the grating in one embodiment is an intermediate impervious sheet, which defines the bottom surface of the top layer and serves to prevent the top layer from penetrating and filling the interstices of the grating. The top layer is the wear surface of the pavement module and, in the preferred embodiment, is composed of a concrete formulation suitable as the wear surface.

The invention claimed and described herein, in one embodiment, uses an impervious intermediate layer to prevent the concrete wear surface from filling the interstices of the base grating. The intermediate sheet also provides an effective barrier and coating for the grating or grid base support member to protect it from the elements and premature deterioration. As an alternative embodiment, the impervious intermediate layer may be made of a degradable material which will decompose after the concrete wear surface has cured. A pavement module according to the present invention may be constructed without an impervious intermediate layer by making the pavement module in any manner in which the concrete wear surface can cure without penetrating the interstices of the base grating. One method of forming the module without an intermediate layer is to put the top layer wear surface in a form and to place the base layer, upside down, on the wear surface. Preferably, the module will then be vibrated to help the wear surface to set properly to ensure that the shear connectors are fixed within the wear surface. The module can be vibrated on a shake table or any other vibrating means as is known in the art. The weight of the panel, according to the invention, is approximately 40% of the prior art designs.

In order to maintain the structural integrity of the pavement module, in the preferred embodiment the base layer grating is provided with studs or other shear connectors welded to the grating. The studs are essentially perpendicular to the grating. The studs pass through the intermediate sheet and into, but not through, the concrete wear surface layer.

By preventing the concrete wear surface from penetrating and filling the interstices of the grating, a light weight, strong, long wearing readily transportable pavement module is formed. Units of new or replacement pavement can be shipped to the job site for immediate installation and use. The pavement module can be prepared in a factory under ideal conditions to achieve a much higher quality wearing surface than can be achieved when such wear surfaces are prepared in the field. Additionally, since the module is ready for immediate installation, construction vagaries, such as weather, can be avoided and traffic and pedestrian inconvenience can be kept to minimum.

DESCRIPTION OF THE PREFERRED EMBODIMENT

Figure 1:
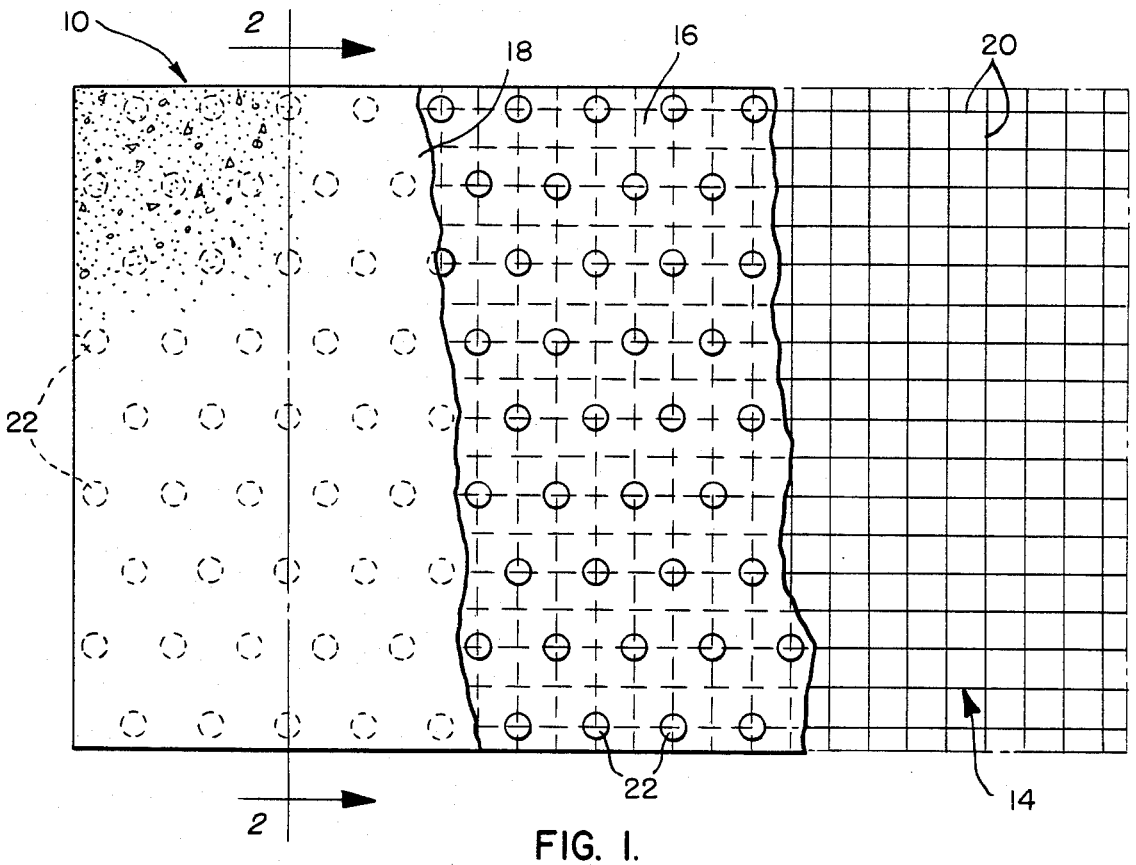
FIG. 1 is a plan view of a pavement module constructed according to the invention described and claimed herein.
Figure 2:
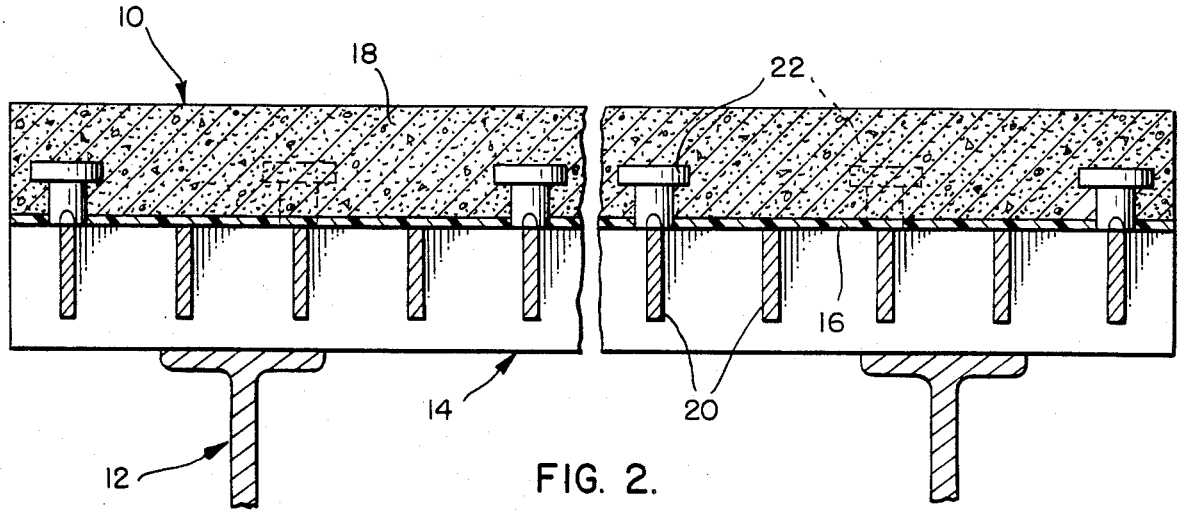
FIG. 2 is a cross-section of a pavement module taken along line 2—2 of FIG. 1.

The invention disclosed and claimed herein comprises a pavement module generally indicated at 10. The module is intended to be placed on a prepared road bed or bridge floor framing members as is generally shown at 12. In the preferred embodiment, the module includes a base layer 14, an intermediate layer 16 and a top layer 18.

In the preferred embodiment, the base layer is a grid or grating generally shown at 20. The grid may be made of metal, plastic, or any other suitable material. The grid is constructed in a conventional fashion with spaced parallel cross bars separated by interstices. The material and specifications of the grid are chosen to meet the particular load requirements and needs of the job. Studs or other shear connectors 22 are formed on the metal grid to pass through the intermediate layer and into the top layer to provide structural integrity of the pavement module and to permit the base layer and top layer to function in a complementary fashion. These shear connectors may be either welded or otherwise fixed to base layer 20 or may be integrally formed on base layer 20, such as by constructing base layer 20 with a ragged or irregular top surface. The grid may be either galvanized, coated with an epoxy, or otherwise protected from future deterioration. Such protective coatings are well known in the art and typically take the form of an organic, powdered epoxy resin applied to the grid by an electrostatic process. Galvanized, aluminum anodic and aluminum hot dip coatings are also well known and equally effective.

In a preferred embodiment, an intermediate layer 16 is used. Layer 16 may be a reinforced plastic or fiberglass sheet or any material which is generally impervious to the passage of concrete material and serves to prevent the top layer from penetrating the base layer and filling the interstices of the base grid. Intermediate layer 16 also serves to protect the grid from the elements and this prevents premature deterioration. The primary purpose, however, of intermediate layer 16 is to define the bottom surface of the concrete layer opposite the wear surface. Thus, the intermediate sheet may be a biodegradable material, such as a reinforced paper sheet, which will deteriorate over time after the concrete cures. Once the concrete has cured and bonded to the metal grid and studs, the intermediate layer is no longer necessary to prevent the concrete from filling the interstices of the grid. Accordingly, as an alternative embodiment, module 10 may be constructed without intermediate layer 16 by making the pavement module in any manner in which the top layer 18 will cure without penetrating and filling the interstices of base layer 14. One method of constructing module 10 without intermediate layer 16 is for base layer 14 to be placed upside down on top of top layer 18, which would be inside a forming fixture, and to gently vibrate both layers so that top layer 18 cures to base layer 14 but does not penetrate and fill the interstices of base layer 14. One well-known method of vibrating the module is to use a shake table, but other vibrating means may also be used.

The top layer in the preferred embodiment is a high density low slump concrete, although other concrete formulations suitable as the wear surface may also be used. High density concrete is preferrable because it serves as an additional barrier to prevent moisture from reaching the base member grid or grating and causing premature deterioration. A typical high density concrete would include approximately 31% each of coarse and fine aggregate; 6% air; 16% water; and 16% cement. A typical low slump might be approximately $\frac{3}{4}$ inch. A latex modified concrete, as is well known in the art, could also be used as the top layer. The concrete wearing surface can be much higher quality concrete than can be achieved when the wear surface is applied in the field since the concrete layer can be prepared under ideal conditions in a factory. In the preferred embodiment, the concrete layer should be approximately one and one-half to three inches thick. Preferably, the concrete layer also will be integrally reinforced, such as with welded mesh, reinforcing bars, or other means of concrete reinforcement as is well-known in the art.

Although the invention has been described with reference to a preferred embodiment, many changes will be apparent to those skilled in the art. The invention is defined and limited only by the following claims.

I claim:

1. A method of making a pavement module comprising:

forming an open-lattice grating base member having a top surface and bottom surface by intersecting and interlocking a plurality of primary load bearing bars with a plurality of secondary load bearing bars to distribute load transverse to said primary load bearing bars;

forming a plurality of shear connectors on said top surface of said grating base member; and providing a concrete wear member having a planar top surface and a planar bottom surface fixed to and on top of said grating base member above said top surface of said grating base member, said planar bottom surface of said concrete wear member essentially coplanar with said top surface of said grating base member so that said concrete wear member does not fill the interstices of said grating base member; and embedding said shear connectors within said concrete wear member to effect horizontal shear transfer and to prevent vertical separation between said concrete wear member and said grating base member.

2. A method as recited in claim 1 further comprising the step of providing an intermediate member fixed to said grating base member which defines said top surface of said grating base member.

3. A method of making a road bed comprising the steps of:

forming an open-lattice grating base member having a top surface and a bottom surface by intersecting and interlocking a plurality of primary load bearing bars and a plurality of secondary load bearing bars to distribute load transverse to said primary load bearing bars;

forming a plurality of shear connectors on said top surface of said grating base member;

providing a concrete wear member having a planar top surface and a planar bottom surface on top of and fixed to said grating base member, said planar bottom surface of said concrete wear member essentially coplanar with said top surface of said grating base member so that said concrete wear member does not fill the interstices of said grating base member; and embedding said shear connectors within said concrete wear member to effect horizontal shear transfer and to prevent vertical separation between said concrete wear member and said grating base member.

4. A method as recited in claim 3 further comprising the steps of abutting said concrete wear member against said grating base member so that there is substantially planar contact between the top surface of said grating base member and said planar bottom surface of said concrete wear member.

5. A method recited in claim 3 further comprising the step of providing an intermediate member fixed to said grating base member which defines said top surface of said grating base member.

* * * * *